US007228098B2

(12) United States Patent
Herley et al.

(10) Patent No.: US 7,228,098 B2
(45) Date of Patent: Jun. 5, 2007

(54) FUSING ASSEMBLY HAVING A TEMPERATURE EQUALIZING DEVICE

(75) Inventors: James A. Herley, Chesapeake, VA (US); Nicholas Kladias, Ossining, NY (US); Gerald A. Domoto, Briarcliff Manor, NY (US)

(73) Assignee: Xerox Corporation, Stamford, CT (US)

( * ) Notice: Subject to any disclaimer, the term of this patent is extended or adjusted under 35 U.S.C. 154(b) by 241 days.

(21) Appl. No.: 10/975,680

(22) Filed: Oct. 28, 2004

(65) Prior Publication Data

US 2006/0093412 A1 May 4, 2006

(51) Int. Cl.
*G03G 15/20* (2006.01)

(52) U.S. Cl. ..... 399/328; 399/320; 399/334; 165/185

(58) Field of Classification Search ..... 399/328, 399/334, 320; 165/185
See application file for complete search history.

(56) References Cited

U.S. PATENT DOCUMENTS 5,602,635 A 2/1997 Domoto et al.
6,353,718 B1 3/2002 Roxon et al.
2004/0188081 A1* 9/2004 Oh ..... 165/185

* cited by examiner

*Primary Examiner*—David M. Gray
*Assistant Examiner*—Ryan D. Walsh
(74) *Attorney, Agent, or Firm*—Tallam I. Nguti

(57) ABSTRACT

A fusing assembly includes (a) a first member having a first edge, a second edge and an end-to-end axis; (b) a second member having a fusing surface forming a fusing nip with the first member, and the fusing nip being located between the first edge and the second edge of each of the first member and the second member; (c) a heating member extending along the end-to-end axis for heating at least one of the first member and the second member to an image marking material fusing temperature; and (d) a temperature equalizing device for equalizing a temperature of the at least one of the first member and the second member, the temperature equalizing device including plural heat conductors, each heat conductor of the plural heat conductors including a first end and a second end, a body portion between the first end and the second end, the body portion being spaced from and out of contact with the fusing surface of the second member with only the first end and the second end discretely contacting the fusing surface, with the first end and the second end being arranged in an overlapping manner, for contacting the at least one of the first member and the second member at a first contact point and at a second contact point respectively for conducting heat from one of the first contact point and the second contact point to the other.

20 Claims, 4 Drawing Sheets

FUSING ASSEMBLY HAVING A TEMPERATURE EQUALIZING DEVICE

The present disclosure is directed to electrostatographic reproduction machines, and more particularly, concerns a fusing assembly in such a machine including a temperature-equalizing device.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member surface such that the developing material is attracted to the charged image areas on the photoconductive surface.

Thereafter, the developing material is transferred from the photoreceptive member to a receiving copy sheet or to some other image supporting substrate, to create an image, which may be permanently affixed thereto by a heated fixing or fusing method and apparatus, thereby providing an electrostatographic reproduction of the original document. In a final step in the process, the photoconductive surface of the photoreceptive member is cleaned with a cleaning device in order to remove any residual developing material, which may be remaining on the surface thereof in preparation for successive imaging cycles.

The electrostatographic copying process described hereinabove, for electrostatographic imaging is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

In order to fix or fuse toner images onto a substrate, the fixing or fusing method and apparatus typically includes a heated fixing or fusing member heats the toner to a point where the toner coalesces and become tacky. The heat causes the toner to flow into the fibers or pores of the substrate. The fixing or fusing method and apparatus also includes a pressure member that adds pressure to increase the toner flow. Upon cooling, the toner becomes permanently attached to the substrate.

Typically such fixing or fusing takes place in a fusing nip formed by the fusing member and the pressure member, both of which are typically rollers. Typically, the fuser roll and pressure roll are longitudinally long enough to handle letter-size and larger-size sheets. Therefore, when running many copies of narrow media (8.5×11) in the machine and through the fuser or fusing apparatus, the temperature of the fuser roll in portions thereof not in contact with the narrow media, (portions outside the media path) have been found to increase considerably relative to the temperature of portions being contacted by such media (portions inside the media or paper path). In addition, as the fuser roll wall is made thinner and thinner in order to enable Energy Star compliance, it has been found that axial temperature non-uniformity becomes larger and larger. Ideally, the axial temperature profile of the fuser roll should be as uniform as possible in order to enable optimal energy consumption, and to avoid print quality defects caused by over or under heating of the fusing system.

Prior art examples of efforts to resolve the above non-uniformity include U.S. Pat. No. 5,602,635 entitled "Rapid wake up fuser" that discloses an apparatus for fusing images to a sheet including a transparent fusing roll having an internal heating device that focuses the energy to a narrow area of the roll adjacent the nip formed with a pressure roll. A lateral temperature smoothing device, or leveling roll, is also provided to maintain a fairly uniform temperature axially across the fuser roll. This is particularly useful for a wide fuser roll, i.e., 17 inches, through which narrower paper, i.e., 11 or 14 inches, is passing to prevent the ends of the fuser roll which do not contact the paper from overheating. A quick start up from cold start is possible so that no standby power is required.

U.S. Pat. No. 6,353,718, entitled "Xerographic fusing apparatus with multiple heating elements" discloses fusing apparatus for xerographic printing includes a fuser roll with two parallel lamps, or heating elements, therein. Each lamp defines a relatively hot end and a relatively cold end when electrical power is applied. The two lamps are disposed so that a hot end of one lamp is adjacent to the cold end of the other lamp. At power-up, power is applied to each lamp in a stair-step fashion, in which incremental increases in applied power for each lamp are staggered in time. Also during power-up, the lamps are connected in series, but the series connection is removed for a running condition. These features contribute to desirable anti-flicker effects of the whole apparatus.

U.S. Pat. No. 6,577,836 entitled "Image-forming apparatus and fixing unit with heat circulator for high heat exchange efficiency" discloses image-forming apparatus, a fixing unit and a heat circulation system are equipped with a heat circulator capable of being fabricated at low costs and ensuring high heat exchange efficiency. The heat circulator includes two tabular metal members that come into contact with an intermediate transfer member at positions upstream and downstream of a simultaneous transfer and fixing zone, and plural heat pipes that transfer the heat of the first metal member to the second metal member.

SUMMARY

In accordance with the present disclosure, there is provided a fusing assembly including (a) a first member having a first edge, a second edge and an end-to-end axis; (b) a second member forming a fusing nip with the first member, and the fusing nip being located between the first edge and the second edge of each of the first member and the second member; (c) a heating member extending along the end-to-end axis for heating at least one of the first member and the second member to an image marking material fusing temperature; and (d) a temperature equalizing device for equalizing a temperature of the at least one of the first member and the second member, the temperature equalizing device including plural heat conductors, each heat conductor of the plural heat conductors including a first end and a second end, arranged in an overlapping manner, for contacting the at least one of the first member and the second member at a first contact point and at a second contact point respectively for conducting heat from one of the first contact point and the second contact point to the other.

BRIEF DESCRIPTION OF THE DRAWINGS

The foregoing and other features of the instant disclosure will be apparent and easily understood from a further reading of the specification, claims and by reference to the accompanying drawings in which:

DETAILED DESCRIPTION

While the present disclosure will be described hereinafter in connection with a preferred embodiment thereof, it should be understood that it is not intended to limit the disclosure to that embodiment. On the contrary, it is intended to cover all alternatives, modifications and equivalents as may be included within the spirit and scope of the disclosure as defined in the appended claims.

Figure 1:
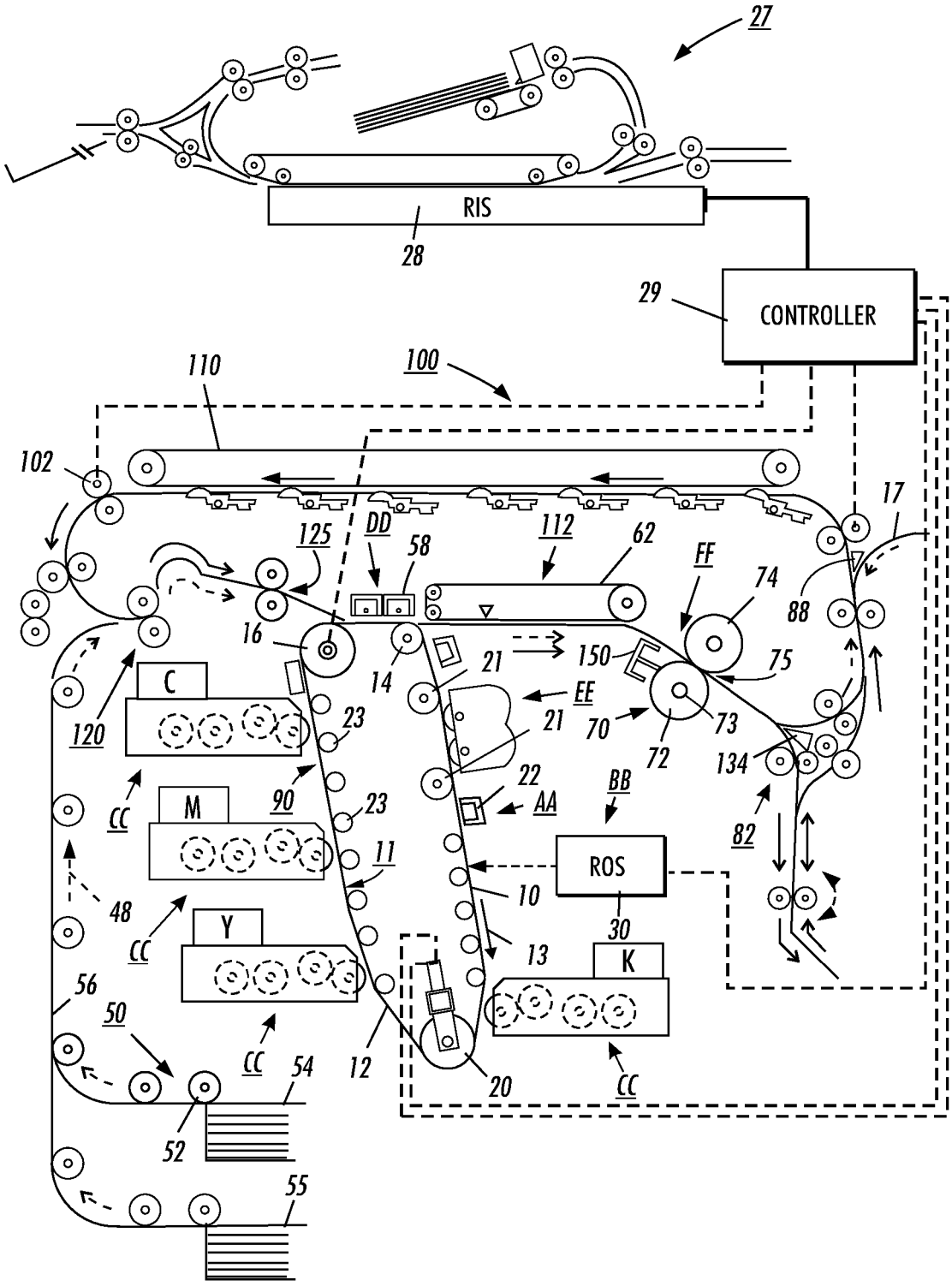
FIG. 1 is a schematic elevational view of an electrostatographic reproduction machine depicting the fusing assembly including the temperature-equalizing device of the present disclosure.

FIG. 1 schematically illustrates an electrostatographic reproduction machine, which generally employs a photoconductive belt 10 mounted on a belt support module 90. Preferably, the photoconductive belt 10 is made from a photoconductive material coated on a ground layer that, in turn, is coated on an anti-curl backing layer. Belt 10 moves in the direction of arrow 13 to advance successive portions sequentially through the various processing stations disposed about the path of movement thereof. Belt 10 is entrained as a closed loop 11 about stripping roll 14, drive roll 16, and idler roll 21. Belt 10 as loop 11 is also entrained about the fast acting fusing apparatus 70 of the present disclosure. As drive roll 16 rotates, it advances belt 10 in the direction of arrow 13.

Initially, a portion of the photoconductive belt surface passes through charging station AA. At charging station AA, a corona-generating device indicated generally by the reference numeral 22 charges the photoconductive belt 10 to a relatively high, substantially uniform potential.

As further shown, the reproduction machine 8 includes a controller or electronic control subsystem (ESS), indicated generally be reference numeral 29 which is preferably a self-contained, dedicated mini-computer having a central processor unit (CPU), electronic storage, and a display or user interface (UI). The ESS 29, with the help of sensors and connections, can read, capture, prepare and process image data and machine status information. As such, it is the main control system for components and other subsystems of machine 8 including the fast acting fusing method and apparatus 70 of the present disclosure.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image which is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. The ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station CC, which includes four developer units containing cmyk color toners, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station DD. A print sheet 48 is advanced to the transfer station DD, by a sheet feeding apparatus 50. Preferably, sheet feeding apparatus 50 includes a feed roll 52 contacting the uppermost sheet of stack 54. Feed roll 52 rotates to advance the uppermost sheet from stack 54 to vertical transport 56. Vertical transport 56 directs the advancing sheet 48 of support material into registration transport 57 past image transfer station DD to receive an image from photoreceptor belt 10 in a timed sequence so that the toner powder image formed thereon contacts the advancing sheet 48 at transfer station DD. Transfer station DD includes a corona-generating device 58, which sprays ions onto the backside of sheet 48. This attracts the toner powder image from photoconductive surface 12 to sheet 48. After transfer, sheet 48 continues to move in the direction of arrow 60 by way of belt transport 62, which advances sheet 48 to fusing station FF.

Fusing station FF includes a fuser assembly indicated generally by the reference numeral 70, which permanently affixes the transferred toner power image to the copy sheet, as well as the temperature-equalizing device 150 in accordance with the present disclosure. Preferably, fuser assembly 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll may be internally heated as by a quartz lamp (not shown).

In operation, the toner image carrying sheet then passes through fuser 70 where the image is permanently fixed or fused to the sheet. After passing through fuser 70, a gate either allows the sheet to move directly via output 17 to a finisher or stacker, or deflects the sheet into the duplex path 100, specifically, first into single sheet inverter 82 here. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station EE. Cleaning station EE includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Typically, the fuser roll 72 and pressure roll 74 are longitudinally long enough to handle letter-size and larger-size sheets. Therefore, when running many copies of narrow media (8.5×11) in the machine and through the fuser 70, the temperature of the fuser roll 72 in portions thereof not in contact with the narrow media, (portions outside the media path) increases considerably relative to the temperature of portions being contacted by such media (portions inside the media or paper path). In addition, as the fuser roll wall is made thinner and thinner in order to enable Energy Star compliance, it has been found that axial temperature non-uniformity becomes larger and larger. Ideally, the axial temperature profile of the fuser roll should be as uniform as possible in order to enable optimal energy consumption, and to avoid print quality defects caused by over or under heating of the fusing system.

Figure 2A:
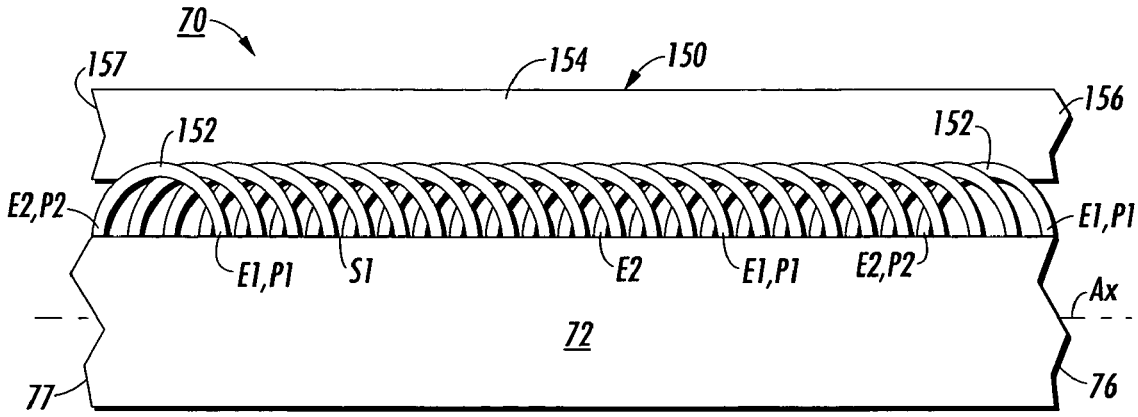
FIG. 2A is a schematic illustration of a portion of the fusing assembly of FIG. 1 including a first embodiment of the temperature-equalizing device of the present disclosure.
Figure 2B:
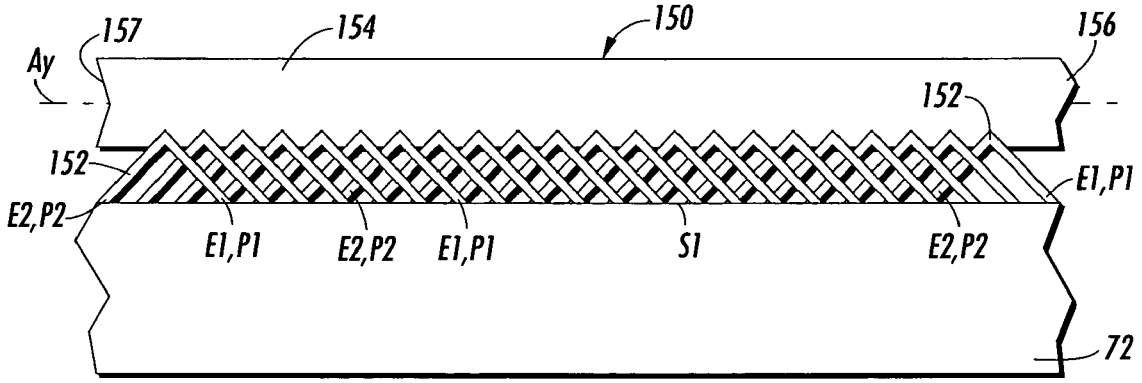
FIG. 2B is a schematic illustration of a portion of the fusing assembly of FIG. 1 including a second embodiment of the temperature-equalizing device of the present disclosure.
Figure 3:
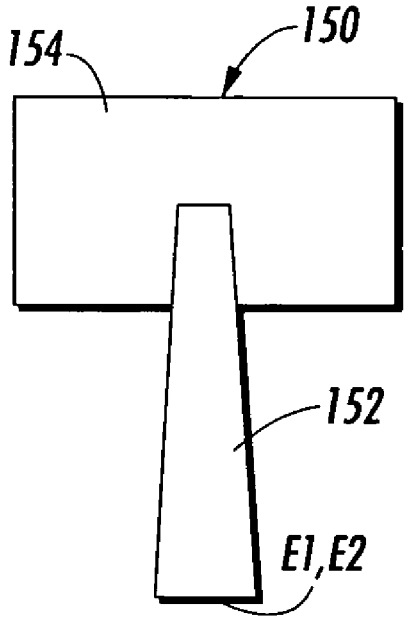
FIG. 3 is a schematic illustration of an end view of the embodiment of FIG. 2*a;*
Figure 4:
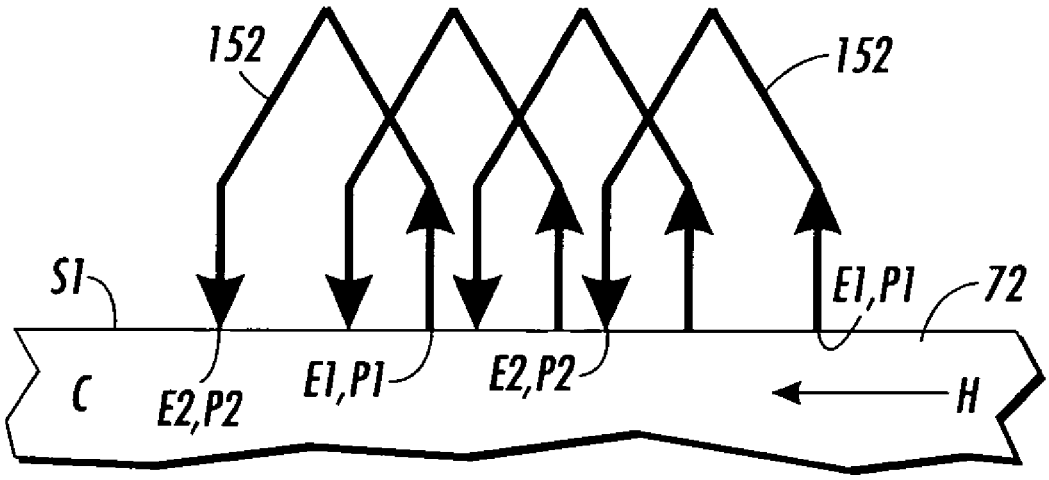
FIG. 4 is a graphical illustration of heat conduction by heat conductors of the embodiment of FIG. 2B.
Figure 5:
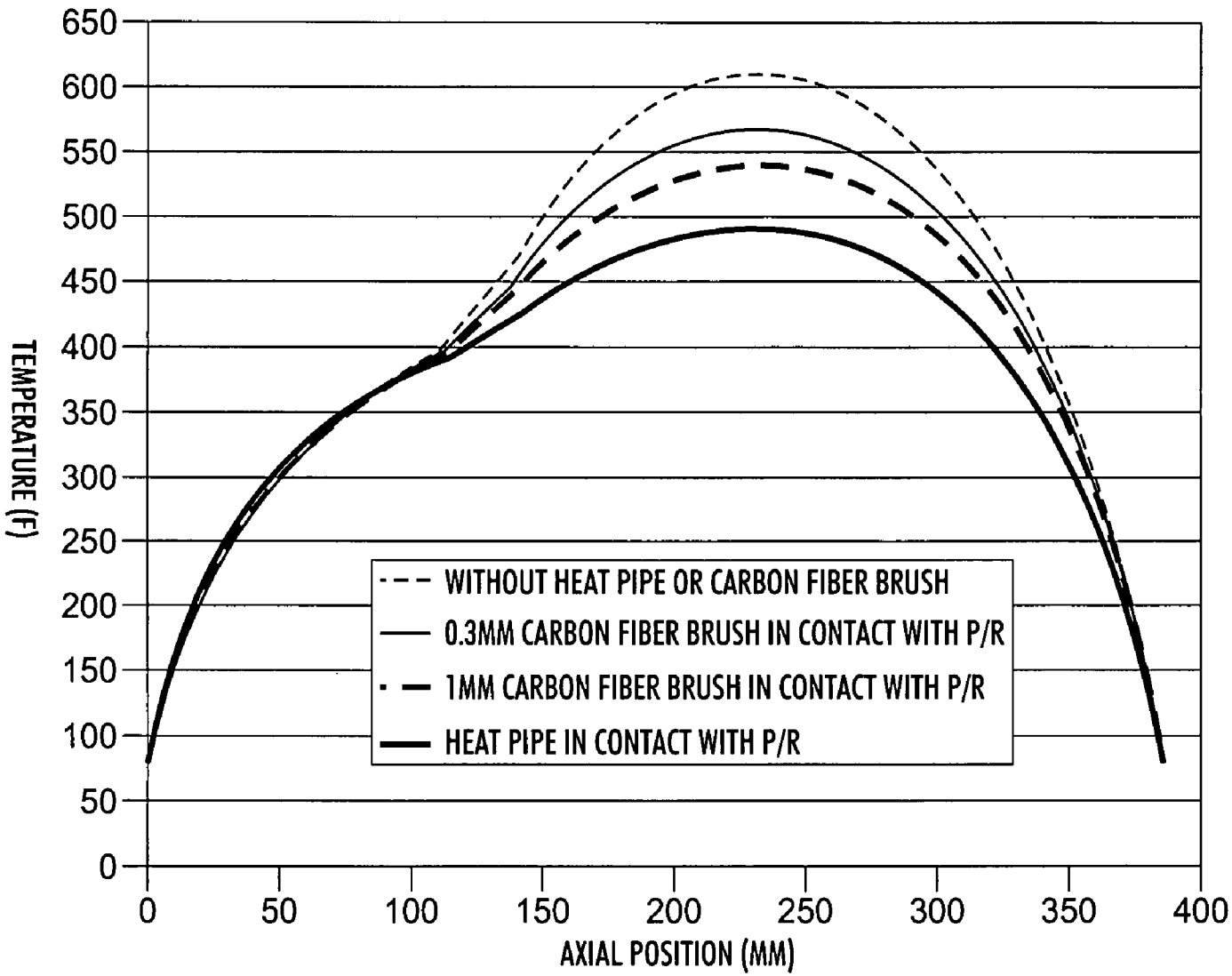
FIG. 5 is a graphical illustration of temperature versus axial position of a number fusing devices including one assembled in accordance with the present disclosure.

Referring now to FIGS. 1-5, details of the fusing assembly 70 including the temperature-equalizing device 150 of the present disclosure, are illustrated. FIG. 2A is a schematic illustration of a portion of the fusing assembly of FIG. 1 including a first embodiment of the temperature-equalizing device of the present disclosure. FIG. 2B is a schematic illustration of a portion of the fusing assembly of FIG. 1 including a second embodiment of the temperature-equalizing device of the present disclosure. FIG. 3 is a schematic illustration of an end view of the embodiment of FIG. 2A. FIG. 4 is a graphical illustration of heat conduction by heat conductors of the embodiment of FIG. 2B; and FIG. 5 is a graphical illustration of temperature versus axial position of a number fusing devices including one assembled in accordance with the present disclosure.

As shown, the fusing assembly 70 in general includes (a) a first member 72 having a first end 76, a second end 77, and an end-to-end axis Ax; (b) a second member 74 forming a fusing nip 75 with the first member 72, with the fusing nip 75 being located between the first edge and the second edge of each of the first member and the second member; (c) a heating member 73 extending along the end-to-end axis for heating at least one of the first member and the second member to an image marking material fusing temperature; and (d) a temperature-equalizing device 150 for axially equalizing a temperature of the at least one of the first member and the second member. As shown, the first member and the second member can each comprise a roller. However, as is well known, the second member could comprise a continuous belt.

As shown in FIGS. 2A and 2B, the temperature-equalizing device 150 includes a holder, and plural heat conductors 152 that each are attached to the holder 154 and has a first end 156 and a second end 157 for contacting the at least one of the first member and the second member discretely at a first contact point P1 and at a second contact point P2 respectively for conducting heat from one of the first contact point and the second contact point to the other depending on which is relatively hotter than which.

The temperature equalizing device includes the frame or holder 154 for supporting the plural conductors 152. The plural heat conductors 152 comprise a series of heat conductors each of which has a first end E1, second E2, and a body portion 152 connecting the first end E1 and the second end E2 as clearly shown. Additionally, as clearly shown in FIGS. 2A and 2B, the body portion of each conductor 152 is curved and spaced or out of contact with the surface S1 for positioning only the first end E1 at the first contact point P1 on the surface S1 of the fusing member 72, and only the second end E2 thereof at the second contact point P2 substantially within a common plane S1 on the surface of the fusing member 72. The heat conductors 152 together are arranged and supported or attached with the first ends E1 and second ends E2 discretely contacting, and the body portions 152 spaced from, such surface of the fusing member 72 in an end-to-end overlapping manner along the longitudinal axis Ay of the holder or frame 154. The frame or holder 154 is made of aluminum for example. In one embodiment the first end E1 and the second end E2 of one conductor are arranged in an overlapping manner with the first end E1 and the second end E2 of the next conductor, as above.

In accordance with the present disclosure, each heat conductor 152 comprises a fiber strand, for example a carbon fiber strand. The curve of each strand is such that as clearly shown, the body portion of each heat conductor 152 of the plural heat conductors is V-shaped. Alternatively, the curve can also be such that as clearly shown, the body portion of each heat conductor 152 of the plural heat conductors is U-shaped. The conductors 152 are attached or supported from the frame 154 such that each first end E1 and each second end E2 of the as clearly shown, the body portion of each heat conductor 152 is spaced from and inclined relative to the surface S1 of the fusing member 72 and so makes a non 90° angle contact with the surface S1 of the first fusing member 72, for example. The first contact point P1 and the second contact point P2 are displaced one from another along the end-to-end axis Ax of fusing member 72.

The first contact point P1 and the second contact point P2 are at different temperatures relative to the other thereof. In particular, the temperature-equalizing device 150 should be mounted against the heated fusing member 72 so that it spans or crosses the boundary between the narrow media region, that is, the region of the member 72 that contacts the narrow media (letter size sheets) and the region that lies outside of such narrow media region. Usually as pointed out above, the region outside the narrow media region will be relatively hotter, and so heat conduction by the device 150 will be from hotter region towards the relatively colder region.

Thus in accordance with the present disclosure, in order to equalize the temperature between regions, of the fusing system (fusing member 72), that are at relatively different temperatures, the temperature-equalizing device 150, in the form of a carbon fiber brush is utilized. As illustrated, the device or brush 150 includes U-shaped (FIG. 2A) or V-shaped (FIG. 2B) heat conductors such as carbon fibers 152 that are arranged for providing high axial thermal conductivity and transmission of thermal energy axially (from high to low) along member 72 from one region to an adjacent region (FIG. 4). The carbon fiber brush 150 in contact with a heated fuser roll, for example 72, will continue to transmit thermal energy as such until equilibrium in temperature is attained along the fusing device. This device or carbon fiber brush 150 may be mounted in the fusing assembly 70 so as to make contact with a fusing member 72 or with any other fusing members that is heated directly or indirectly.

The strands of carbon fiber material or conductors 152 are attached or mounted so that they contact the fusing member at an angle other than perpendicular. This will ensure that the fiber ends E1, E2 are displaced by the angular position so as to enable heat entering from one end of the axis of the carbon fiber to be transferred to another location axially along the contacted fusing member. The axially transmitted heat would then be picked up by the first end E1 of another fiber overlapping and starting where a second end E1 of a previous fiber made contact.

The carbon fiber strands or conductors 152 may be continuous in an open ended, "U" type or "V" type configuration (FIGS. 2A, 2B) They can be attached to a holding device or frame 154 that is made of aluminum, plastic or other suitable material that would provide mounting and mechanical rigidity. With this, heat would be conducted and transferred thereof through the carbon fiber along the axis Ax of the heated device 72 from high temperature to low temperature regions.

Advantages of implementing such a device include (a) a more axially uniform temperature fuser profile that will reduce the temperature of "hot spots" along the fuser roll that cause image defects; (b) minimization of excess heat within the machine that may cause problems in adjoining areas; (c) more efficiency in total energy consumption in that excess heat would be diverted to the working area of the roll and be used for fusing rather than being emitted into the surrounding areas; (d) a lower cost alternative to heat pipes and associated hardware; and (e) elimination of the need for specially designed or specially placed heat lamps.

Referring now to FIG. 5, in order to verify the effectiveness of the proposed device, a thermal simulation was been developed where a carbon fiber roll was been placed in contact with the pressure roll in a 55 ppm fusing system. We looked at a worst case scenario where the fuser is heated by a single uniform lamp and the paper is edge registered. Better results can be achieved with using multiple profiled lamps and/or center registered paper. 200 copies of Short Edge Feed A6 paper were run through the system and the pressure roll and fuser roll axial temperature profiles were compared for three configurations: (i) a system where a Heat Pipe contacts the Pressure Roll, (ii) a system where a Carbon Fiber Brush contacts the Pressure Roll, (iii) a nominal system where there is no Heat Pipe or Carbon Fiber Brush in contact with the Pressure Roll.

FIG. 5 shows the pressure roll surface temperature profile for the above three cases. We can see that the temperature difference between the maximum and the minimum temperature on the pressure roll surface before the fusing nip is T=192° C. when neither a heat pipe nor a carbon fiber brush contacts the pressure roll. A 0.3 mm thick carbon fiber brush in contact with the pressure roll reduces this difference to T=153° C. Certainly a heat pipe achieves a more uniform temperature, reducing T=54° C. Better results can be achieved by increasing the carbon fiber brush thickness. For example by increasing the thickness to 1 mm from 0.3 mm the temperature difference between the maximum and the minimum temperature on the pressure roll can be dropped to T=123° C.

In the above simulation we have assumed a 17.1 mm diameter/1.25 mm thickness Heat Pipe roll that can transfer 250 Watts axially over a distance of 5 inches and a temperature difference of 5° C. or a conductance of 6.35 W m/C. Also for the 0.3 mm thick Carbon Fiber Brush the axial thermal conductance is 0.0126 W m/C and for the 1 mm thick Carbon Fiber Brush the axial thermal conductance is 0.0404 W m/C (based on carbon fiber thermal conductivity of 800 W/m C). In all cases we have assumed a 4 mm contact length between the pressure roll and the heat pipe or the carbon fiber.

As can be seen, there has been provided a fusing assembly includes (a) a first member having a first edge, a second edge and an end-to-end axis; (b) a second member forming a fusing nip with the first member, and the fusing nip being located between the first edge and the second edge of each of the first member and the second member; (c) a heating member extending along the end-to-end axis for heating at least one of the first member and the second member to an image marking material fusing temperature; and (d) a temperature equalizing device for equalizing a temperature of the at least one of the first member and the second member, the temperature equalizing device including plural heat conductors, each heat conductor of the plural heat conductors including a first end and a second end, arranged in an overlapping manner, for contacting the at least one of the first member and the second member at a first contact point and at a second contact point respectively for conducting heat from one of the first contact point and the second contact point to the other.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A fusing assembly comprising:

(a) a first member having a first edge, a second edge and an end-to-end axis;

(b) a second member having a fusing surface forming a fusing nip with said first member, and said fusing nip being located between said first edge and said second edge of each of said first member and said second member;

(c) a heating member extending along said end-to-end axis for heating at least one of said first member and said second member to an image marking material fusing temperature; and (d) a temperature equalizing device for equalizing a temperature of said at least one of said first member and said second member, said temperature equalizing device including plural heat conductors, each heat conductor of said plural heat conductors including a first end and a second end, a body portion between said first end and said second end, said body portion being spaced from said fusing surface of said second member with only said first end and said second end discretely contacting said fusing surface, said first end and said second end of one conductor being arranged in an overlapping manner with said first end and said second of the next conductor, for contacting said at least one of said first member and said second member at a first contact point and at a second contact point respectively for conducting heat from one of said first contact point and said second contact point to the other.

2. The fusing assembly of claim 1, wherein said first member comprises a roller.

3. The fusing assembly of claim 1, wherein said second member comprises a roller.

4. The fusing assembly of claim 1, wherein said second member comprises a pressure roller.

5. The fusing assembly of claim 1, wherein said temperature equalizing device includes a frame for supporting said plural conductors.

6. The fusing assembly of claim 1, wherein said first contact point and said second contact point are displaced one from another along said end-to-end axis.

7. The fusing assembly of claim 1, wherein said one of said first contact point and said second contact point are at different temperatures relative to the other thereof.

8. The fusing assembly of claim 1, wherein said body portion of said each heat conductor of said plural heat conductors is curved and spaced from said fusing surface for positioning said first end and said second end thereof substantially within a common plane on said fusing surface.

9. The fusing assembly of claim 1, wherein said each heat conductor comprises a fiber strand.

10. The fusing assembly of claim 1, wherein said each heat conductor is made of carbon.

11. The fusing assembly of claim 5, wherein said frame is made of aluminum.

12. The fusing assembly of claim 8, wherein said body portion of said each heat conductor of said plural heat conductors is V-shaped and spaced from said fusing surface.

13. The fusing assembly of claim 8, wherein said body portion of said each heat conductor of said plural heat conductors is U-shaped shaped and spaced from said fusing surface.

14. The fusing assembly of claim 8, wherein said plural heat conductors include a series of heat conductors arranged in an end-to-end overlapping manner along a longitudinal axis of said frame.

15. The fusing assembly of claim 8, wherein said body portion of said each heat conductor is spaced from and inclined relative to said fusing surface of the fusing member and makes a non 90° angle contact with the surface said first contact point and said second contact point respectively.

16. An image producing machine comprising:

(a) substrate supply and handling means for supplying and moving an image receiving substrate through said machine frame;

(b) imaging means including marking material for forming an image on said image receiving substrate; and (c) a fusing assembly including (i) a first member having a first edge, a second edge and an end-to-end axis; (ii) a second member having a first edge, a second edge and an end-to-end axis; said second member having a fusing surface forming a fusing nip with said first member, and said fusing nip being located between said first edge and said second edge of each of said first member and said second member; (iii) a heating member extending along said end-to-end axis for heating at least one of said first member and said second member to an image marking material fusing temperature; and (iv) a temperature equalizing device for equalizing a temperature of said at least one of said first member and said second member, said temperature equalizing device including plural heat conductors, each heat conductor of said plural heat conductors including a first end and a second end, a body portion between said first end and said second end, said body portion being spaced from said fusing surface of said second member with only said first end and said second end discretely contacting said fusing surface, said first end and said second end being arranged in an overlapping manner for contacting said at least one of said first member and said second member at a first contact point and at a second contact point respectively for conducting heat from one of said first contact point and said second contact point to the other.

17. The image producing machine of claim 16, wherein said temperature equalizing device includes a frame for supporting said plural conductors.

18. The image producing machine of claim 16, wherein said first contact point and said second contact point are displaced one from another relative to said end-to-end axis.

19. The image producing machine of claim 16, wherein said one of said first contact point and said second contact point has a higher temperature relative to the other thereof.

20. The image producing machine of claim 16, wherein said body portion of said each heat conductor of said plural heat conductors is curved for positioning said first end and said second end thereof substantially within a common plane.

* * * * *